US007958928B2

(12) United States Patent
Garlock et al.

(10) Patent No.: US 7,958,928 B2
(45) Date of Patent: Jun. 14, 2011

(54) METHOD AND APPARATUS FOR CASTING METAL ARTICLES

(75) Inventors: Robert M. Garlock, Chardon, OH (US); Gary J. Vanek, Chardon, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 0 days.

(21) Appl. No.: 12/768,256

(22) Filed: Apr. 27, 2010

(65) Prior Publication Data

US 2010/0206510 A1 Aug. 19, 2010

Related U.S. Application Data

(63) Continuation of application No. 12/145,076, filed on Jun. 24, 2008, now abandoned.

(51) Int. Cl.
*B22D 27/00* (2006.01)

(52) U.S. Cl. ..... 164/122.1; 164/122

(58) Field of Classification Search ..... 164/122, 164/122.1, 122.2, 127, 361, 516
See application file for complete search history.

(56) References Cited

U.S. PATENT DOCUMENTS 2,822,308 A 2/1958 Hall
3,598,167 A * 8/1971 Snyderman ..... 164/517
3,598,169 A 8/1971 Copley
3,664,408 A * 5/1972 Eibe ..... 164/241
3,714,977 A 2/1973 Terkelsen
3,915,761 A * 10/1975 Tschinkel et al. ..... 148/404
3,920,063 A 11/1975 Sasaki et al.
4,062,399 A * 12/1977 Lirones ..... 164/338.1
4,714,101 A 12/1987 Terkelsen
5,072,771 A 12/1991 Prasad
5,259,441 A * 11/1993 Staub ..... 164/348
5,275,228 A 1/1994 Wortmann et al.
5,868,194 A 2/1999 Horwood
6,308,767 B1 10/2001 Hugo et al.
6,367,538 B1 * 4/2002 Ghosh et al. ..... 164/338.1
6,446,700 B1 9/2002 Klug
6,467,531 B1 * 10/2002 Doney ..... 164/255
6,776,213 B2 8/2004 Graham et al.
6,827,124 B2 12/2004 Garlock et al.

* cited by examiner

*Primary Examiner* — Jessica L Ward
*Assistant Examiner* — Jacky Yuen
(74) *Attorney, Agent, or Firm* — Tarolli, Sundheim, Covell & Tummino LLP

(57) ABSTRACT

To cast one or more metal articles, a mold structure is positioned on a support with an anchor extending upward from the support into the mold structure. The mold structure and anchor are interconnected by a retainer which extends through a portion of the mold structure into the anchor. When the mold structure is immersed in a cooling bath, force is transmitted between the mold structure and anchor to retain the mold structure against movement relative to the support.

21 Claims, 2 Drawing Sheets

METHOD AND APPARATUS FOR CASTING METAL ARTICLES

RELATED APPLICATION

This application is a continuation of U.S. patent application Ser. No. 12/145,076 filed Jun. 24, 2008 now abandoned. The benefit of the earlier filing date of the aforementioned application Ser. No. 12/145,076 is hereby claimed. The disclosure in the aforementioned application Ser. No. 12/145,076 is hereby incorporated herein in its entirety by this reference thereto.

BACKGROUND OF THE INVENTION

The present invention relates to the cooling of molten metal in a mold with a bath which is at a lower temperature than the molten metal in the mold.

It has previously been suggested that a casting apparatus may employ either a body of molten metal or a fluidized bed as a cooling bath to promote directional solidification of an article in a mold. Apparatus for doing this is disclosed in U.S. Pat. Nos. 6,308,767 and in 6,776,213. When a mold is immersed in a body of molten metal or a fluidized bed, there is a tendency for the mold to move relative to a support on which the mold is disposed.

SUMMARY OF THE INVENTION

The present invention relates to a new and improved method and apparatus for use in casting metal articles. A mold is positioned on a support with an anchor extending upward from the support into the mold. The mold and the anchor are interconnected by a retainer member which extends through a portion of the mold into the anchor.

The mold is at least partially filled with molten metal while the mold is disposed on the support. Thereafter, the mold is at least partially immersed in a bath. Force is transmitted between the mold and the anchor to retain the mold against movement relative to the support during performance of the step of immersing the mold in a bath. The bath may be formed in any desired manner.

The present invention has a plurality of different features which are advantageously utilized together in the manner described herein. However, it is contemplated that the features may be utilized separately and/or in combination with features from the prior art.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
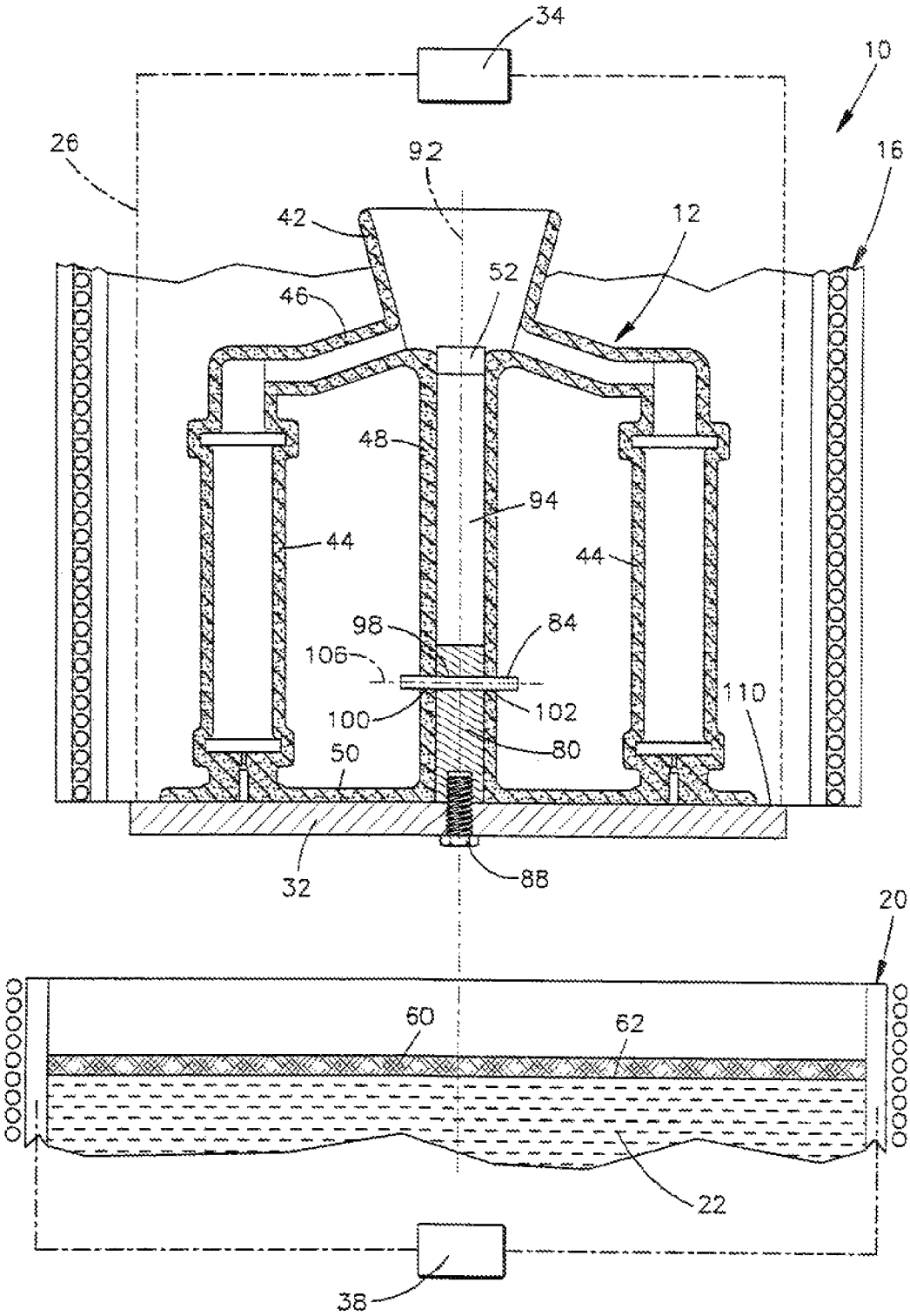
FIG. 1 is a schematic illustration depicting the relationship between a bath and a mold disposed above the bath in a furnace assembly.

An improved casting apparatus 10 is illustrated schematically in FIG. 1 and is utilized in an improved method of casting metal articles in a mold structure 12. The casting apparatus 10 includes a furnace assembly 16 in which a first molten metal is poured into the ceramic mold structure 12 in a known manner. Directly beneath the furnace assembly 16 is a container 20 which holds a bath formed by a body 22 of a second molten (liquid) metal. If desired, the bath may be formed by a fluidized bed.

The casting apparatus 10 is enclosed by a suitable housing (not shown) which is connected with a source of vacuum or low pressure by conduits. The housing enables an evacuated atmosphere to be maintained around the furnace assembly 16 and container 20 holding the body 22 of molten metal. The housing may have any one of many known constructions, including the construction disclosed in U.S. Pat. No. 6,776,213 and/or the construction shown in U.S. Pat. No. 6,308,767. Of course, the housing may have a construction which is different than the known constructions illustrated in the aforementioned patents.

A framework 26 (FIG. 1) is provided to support the mold 12 for movement to and from the furnace assembly 16 and for movement to and from the body 22 of molten metal. The framework 26 includes a mold support 32. The mold support 32 functions as, and may be referred to as, a chill plate. The framework 26 is connected with an upper drive assembly 34 and with the mold support 32. The upper drive assembly 34 is operable to raise and lower the framework 26 relative to the furnace assembly 16 and container 20 holding the body 22 of molten metal or other bath, such as a fluidized bed.

If desired, the mold support 32 may have the same construction as is disclosed in my co-pending U.S. patent application Ser. No. 12/768,314 entitled "Method of Casting Metal Articles". The disclosure in the aforementioned U.S. patent application Ser. No. 12/768,314 is hereby incorporated herein in its entirety by this reference thereto. Alternatively, the mold support 32 may have a circular disk shaped construction.

A lower drive assembly 38 is connected with the container 20 which holds the body 22 of molten metal. The lower drive assembly 38 is operable to raise and lower the container 20 relative to the furnace assembly 16. The upper and lower drive assemblies 34 and 38 may be operated simultaneously and/or sequentially to raise and/or lower the framework 26 and/or container 20 holding the body 22 of molten metal.

During operation of the casting apparatus 10, the one piece ceramic mold structure 12 is supported in the furnace assembly 16 by the framework 26. The mold structure is disposed on the mold support 32 forming the base of the framework 26. The mold structure 12 may have any desired construction and be utilized to cast any desired article. The illustrated mold structure 12 is utilized to cast turbine engine components.

Heat is transmitted from the mold structure to the metal support 32 which functions as a chill plate. The mold structure 12 is raised and lowered relative to the furnace assembly 16 by operation of the upper drive assembly 34 which is connected to the support structure 32. If desired, a flow of cooling liquid may be conducted through the framework 26 and/or mold support 32. It is contemplated that the framework 26 may be constructed so as to be located outside of the furnace assembly 16.

While the mold structure 12 is supported in the furnace assembly 16 on the framework 26, in the manner listed schematically in FIG. 1, the mold structure is preheated to a desired temperature. Molten metal is then poured into a pour cup 42 which is connected with article molds 44 in the mold structure 12 by a gating system 46. A tubular downpole 48 extends downwardly from the pour cup 42 and gating system 46 to a base plate 50 disposed on the mold support 32. A suitable plug 52 is provided in the pour cup 42 to prevent molten metal from flowing from the pour cup 42 into the hollow downpole 48.

With the exception of the plug 52, the illustrated mold structure 12 is of a one-piece ceramic construction. However, the mold structure 12 may be formed by two or more pieces and may have a construction other than a ceramic construction.

The mold structure 12 has a construction which is generally similar to the construction disclosed in U.S. Pat. Nos. 5,048,591; 5,062,468; and/or 5,072,771. The mold structure 12 is utilized to cast turbine engine components. However, it should be understood that the mold structure 12 may have a construction which is different than the construction which is disclosed in the aforementioned patents and/or may be used to cast articles other than turbine engine components.

The mold structure 12 is filled with molten metal while the mold structure is in the furnace assembly 16. The molten metal with which the mold structure is filled is a molten nickel-chrome super alloy which melts at a temperature which is greater than 3,000 degrees Fahrenheit. Of course, the mold structure may be filled with a different molten metal which melts at a different temperature. For example, the mold structure 12 may be filled with molten titanium or a titanium alloy.

Once the mold structure 12 has been filled with the molten nickel-chrome super alloy or other metal, the upper drive assembly 34 is operated to lower the framework and mold structure 12 into the body 22 of a second molten metal in the container 20. While the upper drive assembly 34 is operated to lower the mold structure 12, the lower drive assembly 38 may be operated to raise the body 22 of liquid metal. It should be understood that the mold structure 12 may be immersed in the body 22 of molten metal by lowering the support structure 32 without raising the body 22 of molten metal. Alternatively, the furnace assembly may be raised relative to the mold structure 12 and the body 22 of molten metal raised relative to the mold structure to immerse the mold structure in the body of molten metal. Although either one of the mold structure 12 and body 22 of molten metal may be moved relative to the other to effect immersion of the mold structure 12 in the body 22 of molten metal, it may be desired to both raise the body 22 of molten metal and lower the mold structure 12.

The molten super alloy in the mold structure 12 is at a temperature above 3,000 degrees Fahrenheit. The body 22 of molten metal is at a temperature below 1,000 degrees Fahrenheit. The resulting temperature differential between the molten metal in the mold structure 12 and the molten metal in the body 22 of molten metal results in directional solidification of the molten metal in the mold structure 12 as the mold structure is immersed in the body of molten metal. The molten metal in the mold structure 12 may solidify with either a columnar grain crystallographic structure or with a single crystal crystallographic structure.

In the illustrated embodiment of the invention, the body 22 of molten metal is formed of tin and is at a temperature of approximately 500 degrees Fahrenheit. However, the body 22 of molten metal may be formed of lead or aluminum if desired. The molten metal in the mold structure is a nickel-chrome super alloy with a melting temperature which may be approximately 3,700 degrees Fahrenheit. Of course, a different molten metal may be poured into the mold structure 12. It is also contemplated that the body 22 of molten metal may be replaced by a fluidized bed, in the manner disclosed in the aforementioned U.S. Pat. No. 6,776,213.

It should be understood that the specific temperatures for the body 22 of molten metal and the molten metal in the mold structure 12 will vary depending upon the composition of the metal. For example, the body 22 of molten metal may be any one of many metals which is liquid (molten) at a temperature below 1,500 degrees Fahrenheit. The molten metal in the mold structure 12 may be any one of many different metals which melt at a temperature above 2,000 degrees Fahrenheit.

The greater the temperature differential between the temperature of the molten metal in the mold structure 12 and the body 22 of molten metal, the greater will be the rate in which heat is withdrawn from the molten metal in the mold structure as the mold structure is immersed in the body 22 of molten metal. Of course, the rate of heat transfer from the molten metal in the mold structure 12 to the body 22 of molten metal will also vary as a function of the rate at which the mold structure and body of molten metal are moved relative to each other by the upper and/or lower drive assemblies 34 and 38.

A layer 60 of insulating material is provided above the body 22 of molten metal. The layer 60 of insulating material forms a baffle to block heat transfer to the body 22 of molten metal. Although the baffle provided by the layer 60 of insulating material facilitates maintaining a relatively large temperature differential between the furnace assembly 16 and the body 22 of molten metal, the layer of insulating material may be eliminated if desired.

The layer 60 of insulating material floats on the upper surface 62 of the body 22 of molten metal. The layer of insulating material shields the body 22 of molten metal from the relatively hot environment of the furnace assembly 16. Thus, the layer 60 of insulating material retards heat transfer from the furnace assembly 16 and mold structure 12 to the body 22 of molten metal. This enables the body 22 of molten metal to be maintained at a relatively low temperature during preheating of the mold structure and during pouring of molten metal into the mold structure.

The layer 60 of insulating material may be formed of many different materials. In the illustrated embodiment of the invention, the layer 60 of insulating material is formed of refractory particles which float on the body 22 of molten metal. However, it is contemplated that the layer 60 of insulating material may be formed in a different manner if desired. For example, the layer 60 of insulating material may be formed by hollow members which have a construction similar to any one of the constructions disclosed in U.S. Pat. Nos. 6,446,700 and 6,035,924.

If desired, the layer 60 of insulating material may be disposed above and spaced from the body 22 of molten metal. At least a portion of the layer 60 of insulating material may have a relatively rigid construction and have one or more openings which the mold structure 12 and mold support 32 move. If this is done, the layer 60 of insulating material may be connected with the upper end portion of the container 20.

In the embodiment of the invention illustrated in FIG. 1, the body 22 of molten metal forms a bath in which the mold structure 12 is at least partially immersed to promote directional solidification of molten metal in the mold structure. If desired, the bath may be formed by fluidized bed in a manner similar to the disclosure in the aforementioned U.S. Pat. No. 6,776,213. Of course, the bath may be formed in a different manner if desired.

Anchor

Figure 2:
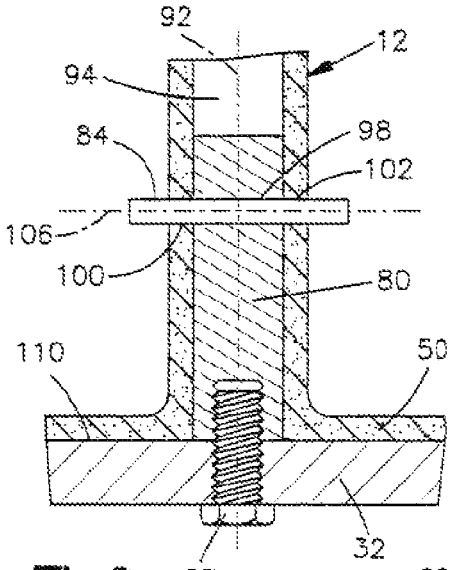
FIG. 2 is an enlarged fragmentary schematic illustration of a portion of FIG. 1 and illustrating the relationship between the mold, a support, and a retainer member which extends through a portion of the mold into an anchor connected to the support.

In accordance with a feature of the present invention, an anchor 80 (FIGS. 1, 2, 3 and 4) is provided to retain the mold structure 12 against movement relative to the mold support 32 as the mold support and mold structure are immersed in the body 22 of molten metal. A retainer member 84 (FIGS. 1 and 2) extends through a portion of the mold 12 into the anchor 80. The anchor 80 is held against movement relative the mold support 32 by a fastener 88.

As the mold structure 12 is immersed in the body 22 of molten metal, force is transmitted between the mold structure 12 and the anchor 80 to retain the mold structure against movement relative to the mold support 32. In addition, force is transmitted between the retainer member 84 and both the mold structure 12 and anchor 80 to further retain the mold structure 12 against movement relative to the mold support 32.

In the illustrated embodiment of the invention, the mold support 32 has a circular configuration. The base plate 50 of the mold structure 12 also has a circular configuration. The article molds 44 are disposed in a circular array about the downpole 48 of the mold structure 12. The downpole 48 is disposed in a central portion of the circular array of article molds 44. It should be understood that the mold support 32 and/or mold structure 12 may have a configuration which is different than the configuration illustrated herein.

The mold support 32, mold structure 12, and downpole 48 have a common central axis 92 (FIG. 1) which is coincident with a central axis of the cylindrical anchor 80. In the embodiment of the invention illustrated in FIG. 1, the anchor 80 extends into a cylindrical opening 94 in the downpole 48. Thus, the cylindrical opening 94 in the downpole 48 forms a socket which receives the anchor 80.

However, it is contemplated that the anchor 80 may be offset to one side of the downpole 48 and the central axis 92 of the mold structure 12. If this is done, the mold structure 12 would be constructed so as to provide a socket at a location offset from the central axis 92 to receive the anchor 80. Although the socket would be offset from the central axis 92 of the mold structure 12 and support 32, the socket may be located in the central portion of the circular array of article molds 44. Alternatively, the socket may be located radially outwardly of the circular array of article molds 44. If desired, the downpole 48 may be eliminated.

Figure 3:
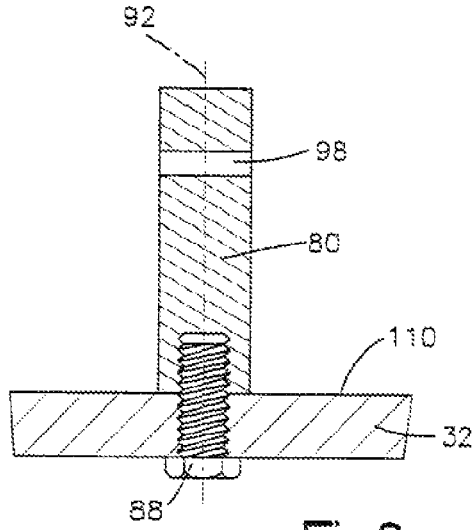
FIG. 3 is a schematic illustration, generally similar to FIG. 2, illustrating the relationship between the support and the anchor prior to positioning of the mold on the support.
Figure 4:
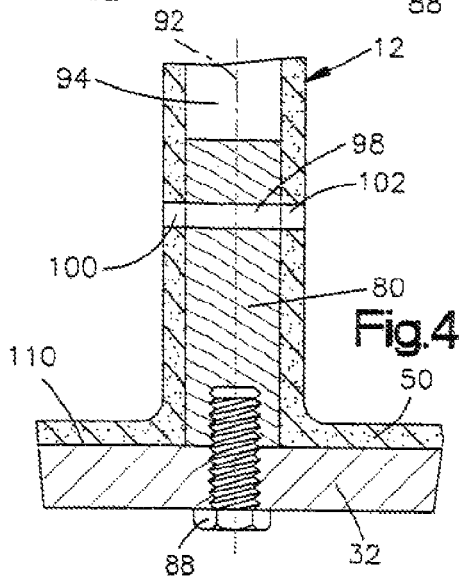
FIG. 4 is a schematic illustration, generally similar to FIGS. 2 and 3, illustrating the manner in which the mold is positioned on the anchor and support of FIG. 3.

The retainer member 84 extends through an opening 98 in the anchor 80 (FIGS. 1 and 3). In addition, the retainer member 84 extends through openings 100 and 102 (FIG. 4) formed in the downpole 48. Although the retainer member 84 extends through the anchor 80 and through openings in opposite sides of the downpole 48, it is contemplated that the retainer member 84 may extend through only one opening in the downpole 48 and extend into the anchor 80 without extending through the anchor.

The retainer member 84 has a central axis 106 (FIGS. 1 and 2) which extends perpendicular to and intersects the central axis 92 of the mold structure 12 and anchor 80. The central axis 106 of the retainer member 84 extends parallel to an upper side surface 110 of the mold support 32. If desired, the retainer member 84 may have a central axis 106 which is skewed at an acute angle relative to the upper side surface 110 of the support 32 and is offset and/or skewed relative to the central axis 92 of the mold structure 12.

In the embodiment of the invention illustrated in FIGS. 1-4, the anchor 80 has a cylindrical configuration. However, it is contemplated that the anchor 80 may have a different configuration if desired. For example, the anchor 80 may have a polygonal cross sectional configuration.

The illustrated anchor 80 extends only partway along the length of the downpole 48. If desired, the anchor may be constructed so as to extend upward to the plug 52 (FIG. 1). If this was done, additional retainer members 84 may be provided in association with the anchor 80. In addition, the plug 52 may be omitted and the bottom of the pour cup 42 closed by the anchor 80.

The anchor 80 is formed of a heat resistant material which can withstand the relatively high heats to which the mold structure 12 is subjected during preheating of the mold structure and pouring of molten metal into the mold structure. In the specific embodiment of the invention illustrated in FIG. 1, the anchor 80 is formed of graphite. However, it is contemplated that the anchor 80 may be formed of a different material if desired. For example, the anchor 80 may be formed of a suitable ceramic material. If the plug 52 is omitted, the anchor 80 may be formed of a ceramic material and have an upper surface which forms the bottom of the pour cup 42.

The retainer member 84 transmits force between the anchor 80 and mold structure 12 to retain the mold structure against vertical movement relative to both the anchor 80 and mold support 32. The illustrated retainer member 84 has a cylindrical configuration and is formed as a pin which extends through both the downpole 48 and the anchor 80. However, the retainer member 84 may be formed of a length such that it extends only partway through both the downpole 48 and the anchor 80.

The illustrated retainer member 84 has a cylindrical configuration. However, the retainer member 84 may have a different configuration if desired. For example, the retainer member 84 may be formed with a polygonal cross sectional configuration. The illustrated retainer member 84 is formed of stainless steel. However, the retainer member 84 may be formed of a suitable heat resistant material, such as a ceramic material.

It is contemplated that the retainer member 84 may be formed with a head end portion which extends radially outward from the cylindrical body of the retainer member 84. The head end portion of the retainer member 84 would engage the outer side surface of the cylindrical downpole 48 to position the retainer member axially relative to both the anchor 80 and downpole. Alternatively, the opening 98 may extend part way through the anchor 80. This would enable the retainer member 84 to be positioned axially relative to the anchor 80 and downpole 48 by engagement with an end surface of the opening 98.

Interconnecting Mold

Structure and Mold Support

The mold structure 12 and mold support 32 are interconnected by the anchor 80 and retainer member 84. Prior to positioning of the mold structure 12 on the support 32, the anchor 80 is secured to the support 32 by the fastener 88 (FIG. 3). At this time, the central axis 92 of the anchor 80 extends perpendicular to the upper side surface 110 of the mold support 32. The mold structure 12 is then lowered onto the support 32.

Prior to lowering of the mold structure 12 onto the support 32, the mold structure is positioned relative to the support with the longitudinal central axis 92 of the mold structure aligned with the longitudinal central axis of the anchor 80. As the mold structure 12 is lowered onto a support 32, the anchor 80 is telescopically inserted into the socket formed by the central opening 94 in the downpole 48. As this occurs, a bottom surface on the base plate 50 of the mold structure 12 engages the upper surface 110 of the mold support 32.

As the mold structure 12 is positioned on the mold support 32 (FIG. 4), the openings 100 and 102 in opposite sides of the downpole 48 are moved into alignment with the opening 98 in the anchor 80. The retainer member 84 can then be inserted through the opening 102 in the downpole 48, through the opening 98 in the anchor 80 and then through the opening 100 in the opposite side of the downpole to locate the retainer member 84 in the position illustrated schematically in FIG. 2. This results in the mold structure 12 and anchor 80 being securely interconnected. If desired, the opening 98 can be formed in the anchor 80 after the mold structure 12 has been positioned on the anchor.

When the support 32 and mold structure 12 are lowered into the body 22 of molten metal, the anchor 80 and retainer member 84 cooperate to hold the mold structure against movement relative to the mold support 32. Thus, sideward forces applied to the mold structure 12 are transmitted through the cylindrical inner side surface of the downpole 48 directly to the anchor 80. In addition, any upward forces applied against the mold structure 12 are transmitted to the anchor 80 through the retainer member 84. This results in the mold structure 12 being held against both sideward and upward movement relative to the mold support 32 as the mold structure is immersed in the body 22 of molten metal. Forces applied to the anchor 80 are transmitted to the mold support 32 by the fastener 88.

Figure 5:
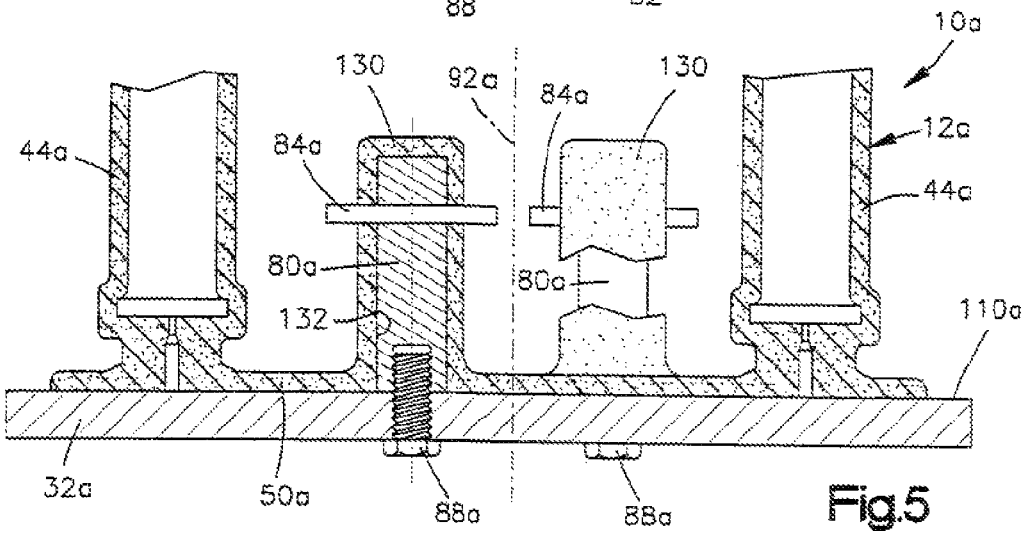
FIG. 5 is a fragmentary schematic illustration depicting the manner in which a plurality of anchors may be utilized to retain a mold against movement relative to a support.

Embodiment of FIG. 5

In the embodiment of the invention illustrated in FIGS. 1 through 4, a single anchor 80 has been provided to retain the mold structure 12 against movement relative to the support 32 during immersion of the mold structure 12 in a cooling bath, such as the body 22 of molten metal or a fluidized bed. In the embodiment of the invention illustrated in FIG. 5, a plurality of anchors are provided to hold the mold structure against movement relative to the mold support during immersion of the mold structure in a cooling bath. Since the embodiment of the invention illustrated in FIG. 5 is generally similar to the embodiment of the invention illustrated in FIGS. 1-4, similar numerals will be utilized to designate similar components, the suffix letter "a" being added to the numerals of FIG. 5 to avoid confusion.

A casting apparatus 10*a* (FIG. 5) includes a furnace assembly (not shown) in which a first molten metal is poured into a ceramic mold structure 12*a* in a known manner. Directly beneath the furnace assembly is a container (not shown) corresponding to the container 20 of FIG. 1, which holds a body of a second molten (liquid) metal, corresponding to the body 22 in FIG. 1 of molten metal. The casting apparatus 10*a* is enclosed by a suitable housing (not shown) which is connected with a source of vacuum or low pressure by conduits.

The mold structure 12*a* (FIG. 5) is disposed on a mold support 32*a*. The circular mold support 32*a* functions as, and may be referred to as a chill plate. An upper drive assembly (not shown) is operable to raise and lower the mold support 32*a* relative to a furnace assembly in the same manner as previously described in conjunction with the embodiment of the invention illustrated in FIG. 1. A lower drive assembly (not shown) is connected with the container which holds the body of molten metal in the same manner as in which the drive assembly 38 of FIG. 1 is connected with the container holding the body 22 of molten metal.

The mold structure 12*a* includes a plurality of article molds 44*a* which extend upwardly from a base plate 50*a* of the mold structure 12*a*. The article molds 44*a* are disposed in a circular array. The base plate 50*a* is integrally formed as one piece with the article molds 44*a*. The mold 12*a* does not have a downpole corresponding to the downpole 48 of FIG. 1.

In accordance with a feature of the embodiment of the invention illustrated in FIG. 5, a plurality of anchors 80*a* are provided to retain the mold structure 12*a* against movement relative to the mold support 32*a* during immersion of the mold structure 12*a* in a body of molten metal, corresponding to the body 22 (FIG. 1) of molten metal. Retainer members 84*a* are provided to interconnect the mold structure 12*a* and the anchors 80*a*. The anchors 80*a* are offset from the central axis 92*a* of the mold structure 12*a*. The anchors 80*a* are connected to the mold support 32*a* by fasteners 88*a*.

The anchors 80*a* are offset to one side of the central axis 92*a* of the mold structure. If desired, one of the anchors 80*a* may be aligned with the central axis 92*a* of the mold structure 12*a*. If the mold structure 12*a* is to be provided with a downpole, the anchors 80*a* would be offset from the downpole and disposed within the circular array of article molds 44*a*.

The mold structure 12*a* includes anchor housings 130 which are integrally formed as one piece with the base plate 50*a*. The mold housings 130 define cylindrical sockets 132 in which the cylindrical anchors 80*a* are telescopically received. The anchor housings 130 are disposed within the circular array of article molds 44*a*. However, one or more of the anchor housings 130 may be disposed radially outward of the circular array of article molds 44*a*.

The retainer members 84*a* have a cylindrical configuration with longitudinal central axes which extend parallel to an upper side surface 110*a* of the mold support 32*a* and perpendicular to central axes of the anchors 80*a* and to the central axis 92*a* of the mold structure 12*a*. The retainer members 84*a* extend through portions of the mold structure, that is, the anchor housings 130, and through the anchors 80*a*.

Conclusion

The present invention relates to a new and improved method and apparatus for use in casting metal articles. A mold 12 is positioned on a support 32 with an anchor 80 extending upward from the support into the mold. The mold 12 and the anchor 80 are interconnected by a retainer member 84 which extends through a portion of the mold 12 into the anchor 80.

The mold 12 is at least partially filled with molten metal while the mold is disposed on the support 32. The mold 12 is at least partially immersed in a bath 22. Force is transmitted between the mold 12 and the anchor 80 to retain the mold against movement relative to the support during performance of the step of immersing the mold in the bath 22. The bath 22 may be formed in any desired manner. For example, the bath 22 may be formed by either a body of molten metal or fluidized bed.

The present invention has a plurality of different features which are advantageously utilized together in the manner described herein. However, it is contemplated that the features may be utilized separately and/or in combination with features from the prior art.

Having described the invention, the following is claimed:

1. A method of casting metal articles, said method comprising the steps of providing a support, positioning a mold on the support with an anchor extending upward from the support into the mold, interconnecting the mold and the anchor with a retainer member which extends through a portion of the mold into the anchor, at least partially filling the mold with a molten metal while the mold is disposed on and is supported by the support, thereafter, at least partially immersing the mold in a bath, and transmitting force between the mold and the anchor to retain the mold against movement relative to the support during performance of said step of immersing the mold in a bath.

2. A method as set forth in claim 1 wherein said step of interconnecting the mold and the anchor with a retainer member includes moving a pin through a portion of the mold into the anchor.

3. A method as set forth in claim 1 wherein said step of positioning the mold on the support includes positioning the mold on the support with a second anchor extending upward from the support into the mold, said method further includes the steps of interconnecting the mold and the second anchor with a second retainer member which extends through a portion of the mold into the second anchor, and transmitting force between the mold and the second anchor to further retain the mold against movement relative to the support during performance of said step of immersing the mold in a bath.

4. A method as set forth in claim 1 wherein said step of positioning the mold on the support includes positioning the mold on the support with a central axis of the anchor coincident with a central axis of the mold.

5. A method as set forth in claim 1 wherein said step of positioning the mold on the support includes inserting the anchor into an opening formed in the mold while the anchor is fixedly connected to the support.

6. A method as set forth in claim 1 wherein the mold includes a pour cup connected in fluid communication with a plurality of article mold cavities, said step of positioning the mold on the support includes moving the anchor into an opening which is formed in the mold and is disposed beneath the pour cup.

7. A method as set forth in claim 1 wherein the mold includes an array of article mold sections, said step of positioning the mold on the support includes moving the anchor into an opening which is disposed in the mold at a central portion of the array of article mold sections.

8. A method as set forth in claim 1 wherein the bath is formed by a body of molten metal which is at a temperature which is less than the temperature of the molten metal in the mold, said step of immersing the mold in the bath includes moving the support and the body of molten metal relative to each other while the body of a molten metal is at a temperature which is less than the temperature of the metal in the mold.

9. A method as set forth in claim 1 wherein said step of interconnecting the mold and the anchor with a retainer member includes moving an end portion of a pin through a first portion of the mold, thereafter, moving the end portion of the pin through the anchor, and, thereafter, moving the end portion of the pin through a second portion of the mold.

10. A method as set forth in claim 1 wherein said step positioning a mold on the support with an anchor extending upward from the support into the mold includes moving an end portion of the anchor into an opening formed in a downpole which extends downward from a pour cup toward the support.

11. A method as set forth in claim 1 wherein the mold includes a base plate and an article mold which extends upward from the base plate, said step of positioning a mold on the support includes positioning the anchor in an opening formed in the base plate of the mold at a location where a central axis of the anchor is offset to one side of the article mold.

12. A method as set forth in claim 1 wherein said step of interconnecting the mold and the anchor with a retainer member includes engaging portions of the mold disposed adjacent opposite sides of the anchor with the retainer member.

13. A method as set forth in claim 1 wherein said step of interconnecting the mold and the anchor with a retainer member includes moving a portion of the retainer member through the portion of the mold into the anchor to a location where the retainer member extends outward from opposite sides of the anchor.

14. A method as set forth in claim 1 wherein the mold includes a base plate and an article mold which extends upward from the base plate, said step of positioning a mold on the support includes moving the base plate and support into engagement and moving an opening formed in the base plate and the anchor to a position in which the anchor extends through the opening in the base plate and is spaced from the article mold with a portion of the base plate disposed between the anchor and the article mold.

15. A method as set forth in claim 1 wherein said step of transmitting force between the mold and the anchor to retain the mold against movement relative to the support includes transmitting force between the mold and the retainer member to retain the mold against movement in a direction away from an upper surface of the support.

16. A method as set forth in claim 15 wherein said step of transmitting force between the mold and the anchor to retain the mold against movement relative to the support includes transmitting force between the mold and the anchor to retain the mold against movement in a direction along the upper surface of the support.

17. A method of casting metal articles, said method comprising the steps of providing a support having an anchor extending upward from an upper side of the support, providing a mold having a base plate with an opening which extends through the base plate and having a plurality of article molds extending upward from the base plate at locations spaced from the opening which extends through the base plate, positioning the base plate of the mold on the support with the anchor extending through the opening in the base plate and with portions of the base plate disposed between the article molds and the anchor, thereafter, moving a retainer member through a portion of the mold into the anchor to interconnect the mold and the anchor while the anchor extends through the opening in the base plate and while the base plate is disposed on the support, thereafter, at least partially immersing the mold in a bath, and transmitting force between the mold, retainer member, and anchor to retain the mold against movement relative to the support during performance of said step of immersing the mold in a bath.

18. A method as set forth in claim 17 wherein the mold includes downpole which extends between a pour cup and the base plate of the mold, said step of positioning the base plate of the mold on the support includes positioning a portion of the anchor in the downpole, said step of moving a retainer member through a portion of the mold into the anchor includes moving the retainer member through a portion of the downpole.

19. A method as set forth in claim 17 wherein said step of moving a portion of the retainer member through a portion of the mold into the anchor includes moving a pin through a portion of the mold into the anchor.

20. A method as set forth in claim 17 further including the step of moving the retainer member through the anchor and a second portion of the mold to a position in which the retainer member extends outward from opposite sides of the anchor and engages the mold at opposite sides of the anchor.

21. A method as set forth in claim 17 wherein said step of providing a support includes providing a support having a plurality of anchors extending upward from an upper side of the support, said step of providing a mold includes providing a mold having a plurality of openings which extend through the base plate of the mold, said step of positioning the base plate of the mold on the support includes positioning the base plate on the support with the plurality of anchors extending through the plurality of openings in the base plate, said step of moving a retainer member into the anchor to interconnect the mold and the anchor includes moving a plurality of retainer members into the anchors of the plurality of anchors.

* * * * *